US011795887B1

(12) United States Patent
Juchems et al.

(10) Patent No.: US 11,795,887 B1
(45) Date of Patent: Oct. 24, 2023

(54) FUEL INJECTOR VARIABILITY REDUCTION

(71) Applicant: Caterpillar Inc., Peoria, IL (US)

(72) Inventors: Mitchell B. Juchems, Tremont, IL (US); Andrew O. Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/813,516

(22) Filed: Jul. 19, 2022

(51) Int. Cl.
*F02D 41/20* (2006.01)
*F02D 41/40* (2006.01)
*F02D 41/22* (2006.01)

(52) U.S. Cl.
CPC ..... *F02D 41/20* (2013.01); *F02D 41/221* (2013.01); *F02D 41/401* (2013.01); *F02D 2041/2041* (2013.01); *F02D 2041/2055* (2013.01); *F02D 2041/2058* (2013.01); *F02D 2041/224* (2013.01)

(58) Field of Classification Search
CPC ..... F02D 41/401; F02D 2041/2017; F02D 2041/2041; F02D 2041/2055; F02D 2041/2058; F02D 2041/2062
USPC ..... 123/299, 479, 490, 500, 502
See application file for complete search history.

(56) References Cited

U.S. PATENT DOCUMENTS

| | | | | |
|---|---|---|---|---|
| 5,678,521 | A * | 10/1997 | Thompson | F02M 41/04 123/446 |
| 5,995,356 | A * | 11/1999 | Glavmo | F02D 41/20 361/160 |
| 7,383,119 | B2 | 6/2008 | Lewis | |
| 9,783,170 | B2 | 10/2017 | Ninoyu et al. | |
| 10,941,738 | B1 * | 3/2021 | Puckett | F02D 41/38 |
| 2003/0120418 | A1 * | 6/2003 | Treichel | F02D 41/345 123/506 |
| 2021/0079878 | A1 * | 3/2021 | Yanoto | F02M 63/0225 |

FOREIGN PATENT DOCUMENTS

| | | | | |
|---|---|---|---|---|
| JP | 3562125 | B2 | 9/2004 | |
| JP | 2013-137028 | A | 7/2013 | |
| JP | 2013137028 | A * | 7/2013 | F02D 41/20 |
| JP | 6797224 | B2 | 12/2020 | |
| WO | 2021171775 | A1 | 9/2021 | |

* cited by examiner

*Primary Examiner* — Erick R Solis
(74) *Attorney, Agent, or Firm* — Bookoff McAndrews, PLLC

(57) ABSTRACT

A fuel injection system includes a fuel injector, the fuel injector having an injection control valve, a solenoid that, when energized, is configured to modify a position of the injection control valve, and a controller. The controller is configured to generate a command for energizing the solenoid, identify variability in one or more injection events, and based on the identified variability, increase an amount of energy supplied to the solenoid.

20 Claims, 5 Drawing Sheets

302
304
306
308
310
312
314
320
320
320
VALVE MOVEMENT TIME
TIME

FUEL INJECTOR VARIABILITY REDUCTION

TECHNICAL FIELD

The present disclosure relates generally to methods and systems for internal combustion engine components and, more particularly, to systems and methods for a fuel injection system with variability reduction.

BACKGROUND

Internal combustion engines of various types include fuel injectors configured to supply a desired amount of fuel. Engines, including high-output engines, have become increasingly efficient and generate a relatively small amount of harmful emissions. To help achieve these improvements, fuel injectors have become increasingly precise. High-precision fuel injectors are desirable, as precise control over the quantity of injected fuel enables reduced emissions and predictable engine control.

During some fuel injection events, it is desirable to inject a relatively small amount of fuel. During these small injection events, instability in the fuel injector due to harmonics or other disturbances can cause the fuel injector to transition from an actuated position to a resting position at a timing that is different from a predicted or desired timing. Variability in this timing can cause the actual amount of injected fuel to deviate from the desired amount of fuel, increasing the generation of undesired emissions, causing undesired noise, and potentially causing engine instability.

An exemplary fuel injection system is described in JP 6797224 B2 ("the '224 patent) to Kusakabe et al. The fuel injection system described in the '224 patent can detect changes in the amount of fuel injected and, in response, adjust the amount of energy used during a pull-in phase of a fuel injector waveform. While the system of the '224 patent may facilitate control over the total amount of fuel injected during a particular injection event, it may be unable to account for transient disturbances or conditions that impact the return of a valve from an injection state to a non-injection state.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a fuel injection system may include a fuel injector, the fuel injector having an injection control valve, a solenoid that, when energized, is configured to modify a position of the injection control valve, and a controller. The controller may be configured to generate a command for energizing the solenoid, identify variability in one or more injection events, and based on the identified variability, increase an amount of energy supplied to the solenoid.

In another aspect, a method for reducing injection variability in a fuel injector having an injection control valve may include monitoring a fuel injector to determine a timing of movement of the injection control valve, identifying a change in a variability of the timing of valve movement for the monitored fuel injector over a plurality of fuel injections, and changing a quantity of current supplied to actuate the injection control valve based on the change in the timing of valve movement.

In yet another aspect, a controller for use in a fuel injection system that includes an internal combustion engine and at least one fuel injector may be programmed to generate a command for energizing a control valve solenoid, determine that a fuel injector movement variability exceeds a movement variability threshold, and based on determining that the fuel injector movement variability exceeds the movement variability threshold, entering a variability reduction mode in which an amount of energy energizing the control valve solenoid is increased for at least a portion of a fuel injection event.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic.

Figure 1:
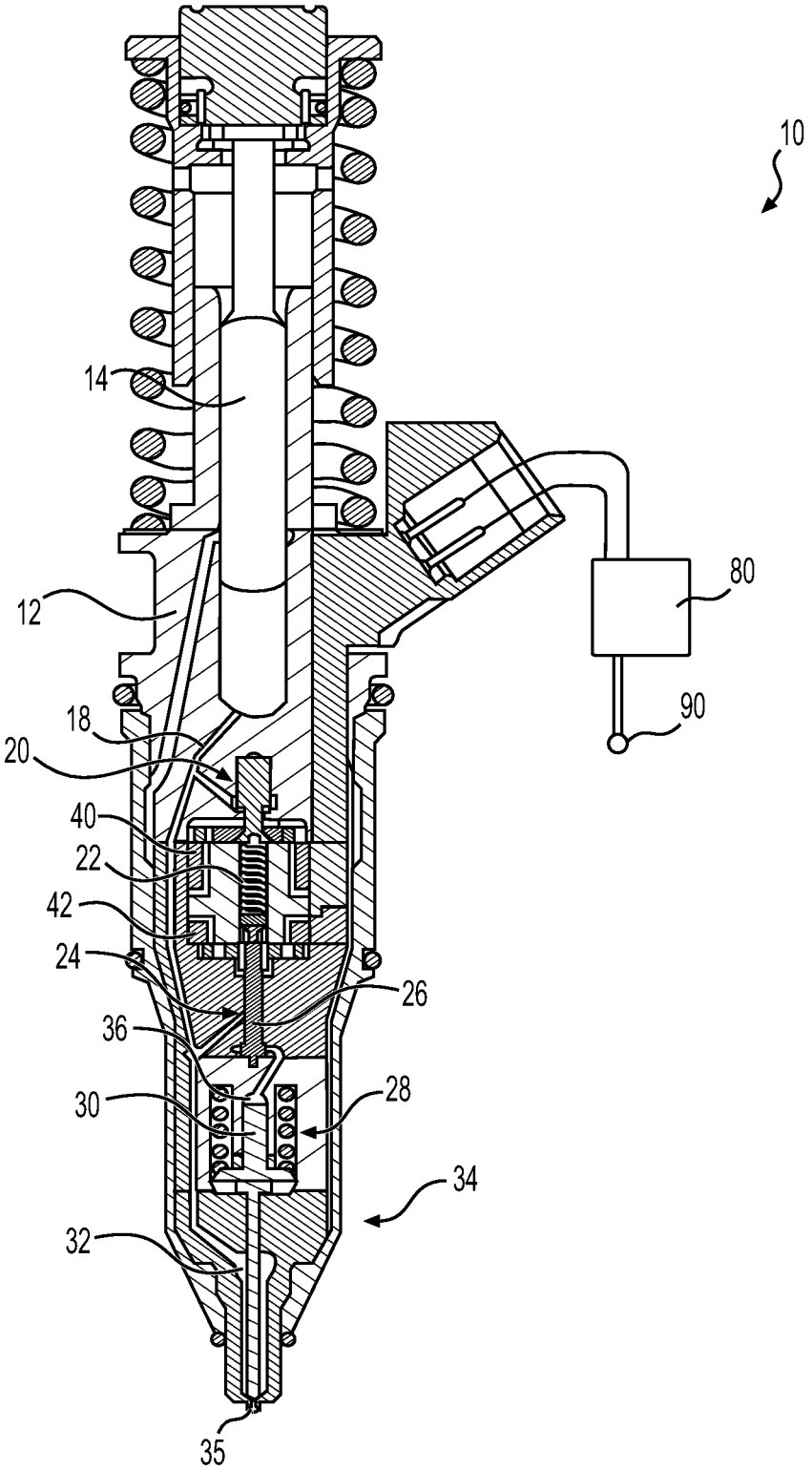
FIG. 1 is a schematic cross-sectional view of an exemplary fuel injection system, according to aspects of the disclosure.

FIG. 1 illustrates an exemplary fuel injection system 10 according to aspects of the present disclosure. Fuel injection system 10 may include a plurality of fuel injectors 12 (one fuel injector 12 shown in FIG. 1), an electronic control module (ECM) 80 in communication with the plurality of fuel injectors 12, an internal combustion engine (not shown) in which fuel injectors 12 are installed, and one or more engine condition sensors 90 that monitor aspects of the engine itself and/or conditions that impact the performance of the engine.

Fuel injector 12 may be a mechanically-actuated electronically-controlled unit injector including a body that houses a cam-driven piston 14, a fuel passage 18 to receive pressurized fuel, fuel supply passage 18 connected downstream of piston 14, a spill valve 20, a control valve 24, and an injection valve 28. Fuel injector 12 may be in communication with ECM 80, to enable ECM 80 to issue commands for actuating spill valve 20 and control valve 24.

Spill valve 20 may be a normally-open valve including a valve member that is movable between an open position and a closed position. A spring member 22 may act to bias spill valve 20 to the open position. When spill valve 20 is open, spill valve 20 may allow fuel to drain and return to the fuel supply system, preventing pressurization of fuel within injector 12. When in the closed position, spill valve 20 may enable pressurization of fuel via piston 14. Spill valve 20 may include a spill valve solenoid 40 for actuating the spill valve member. Spill valve solenoid 40 may be energized in response to commands from ECM 80, the energized state acting to move spill valve 20 to the closed position.

Control valve 24 may be connected between pressurized fuel supply passage 18 and a control chamber 36. Control valve 24 may have a non-injection position and an injection position associated with a control valve member 26. When in the non-injection position, a valve member 26 of control valve 24 may enable fluid communication between control chamber 36 and fuel that is pressurized with piston 14, filling chamber 36 with fuel. When control valve member 26 is in the injection position, control chamber 36 may be depressurized by allowing fuel in chamber 36 to drain from fuel injector 12 to the fuel supply system. Spring member 22 may bias control valve 24 to the non-injection position, so that control valve 24 is brought to the injection position with electromagnetic force created by supplying current to control valve solenoid 42. Spring member 22 may form a single element that biases both spill valve 20 and control valve 24.

ECM 80 may be a control module that controls one or more aspects of system 10, including the behavior of an internal combustion engine. ECM 80 may encompass a single control unit that controls multiple aspects of system 10 and, if desired, aspects of a machine in which system 10 is installed. Alternatively, ECM 80 may be achieved by a plurality of separate control units in communication with each other. For example ECM 80 may operate a hydraulics system for actuating an implement of a machine in addition to operating fuel injectors 12 and other aspects of the engine. ECM 80 may be enabled, via programming, to generate commands that control fuel injection events and commands that reduce valve timing variability (e.g., commands that tend to reduce variability in the operation of control valve 24). In particular, ECM 80 may be configured to generate commands for actuating spill valve 20 and control valve 24 by causing the supply of energy to solenoids 40 and 42, respectively. ECM 80 may also be configured, via programming, to determine valve return timing and identify valve movement (e.g., valve return) variability in a particular fuel injector 12 of a plurality of fuel injectors 12 installed in single engine. ECM 80 may, in response to identifying a particular fuel injector 12 experiencing valve-return variability, generate signals that reduce this variability. These signals may be generated on an injector-by-injector basis, enabling individual control of a plurality of injectors when only a subset of those injectors experience variability. Thus, ECM 80 may be configured to supply one fuel injector 12 of a plurality of fuel injectors 12 installed in a single engine with a greater amount of current for a period of time.

ECM 80 may embody a single microprocessor or multiple microprocessors that receive inputs and generate outputs. ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the functions described with respect to method 400, described below. Numerous commercially available microprocessors can be configured to perform the functions of ECM 80. Various other known circuits may be associated with ECM 80, including current monitoring circuitry, signal-conditioning circuitry, communication circuitry, and other appropriate circuitry.

Engine condition sensor 90 may include a sensor that detects current conditions of the internal combustion engine. While a single sensor 90 is shown in FIG. 1, as understood, sensor 90 may represent a plurality of different sensors. Sensors 90 may monitor, for example, engine speed, engine temperature, air flow, air pressure, ambient temperature, and/or other conditions, including conditions indicative of an engine load. ECM 80 may be configured to receive signals from engine condition sensors 90 and use the information represented by these signals to enable a mode for reducing injector valve variability (e.g., a variability reduction mode), as described below.

Figure 2:
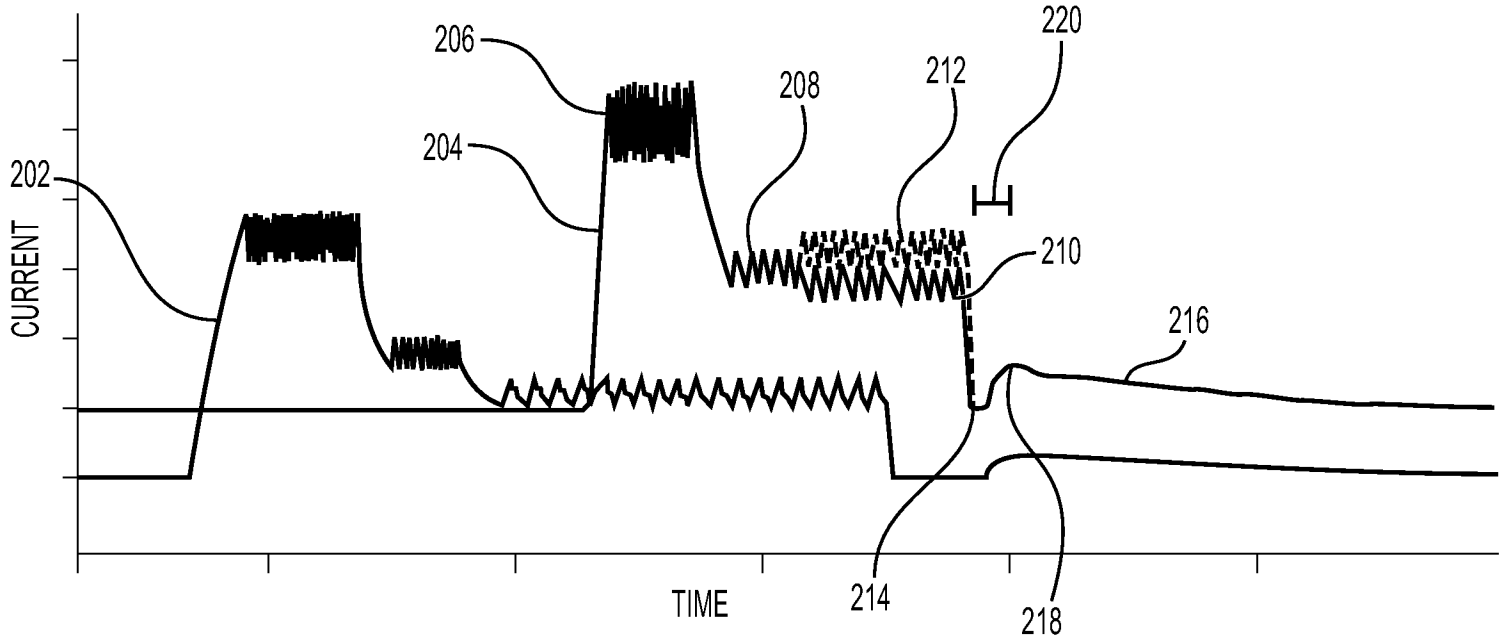
FIG. 2 is a chart showing an exemplary current waveform, including an adjusted region, which may represent a supply of current in the exemplary system shown in FIG. 1.

FIG. 2 is a chart illustrating exemplary waveforms that represent an amount of current through spill valve solenoid 40 and control valve solenoid 42. A spill valve current waveform 202 represents an exemplary amount of current that is supplied to spill valve solenoid 40 during an injection event. Control valve waveform 204 represents an exemplary amount of current supplied to control valve solenoid 42. As used herein, an "injection event" refers to an injection of fuel, directly or indirectly, to a combustion chamber, and includes a main injection, a pilot injection, and/or a post injection. In some aspects, an injection event includes at least a main injection.

Spill valve waveform 202 may include a pull-in portion and a hold-in portion. The pull-in portion may include a maximum current present in waveform 202. The pull-in portion current may be applied during a period of time during which the spill valve transitions from open to closed. The hold-in portion of spill valve waveform 202 follows the pull-in portion and may include one or more current tiers that are smaller than the hold-in current that hold the spill valve in the closed position. In the example illustrated in FIG. 2, the hold-in portion includes intermediate and minimum current levels. While spill valve waveform 202 and control valve waveform 204 are illustrated at different amplitudes (heights) in FIG. 2, these heights are exemplary, with a current of zero amps being represented by the beginning of waveforms 202 and 204 on the left-hand side of FIG. 2 showing the beginning of each waveform.

Control valve waveform 204 may, like spill valve waveform 202, include a pull-in portion (e.g., pull-in current 206) and a hold-in portion constituted by an intermediate hold-in current 208 and a minimum hold-in current 210. Pull-in current 206 may have an amplitude suitable for generating an electromotive force that actuates control valve member 26, while intermediate hold-in current 208 and minimum hold-in 210 may provide progressively-lower levels of current suitable for maintaining control valve member 26 in the actuated injection position. Minimum hold-in current 210 may be maintained until the current reaches a value of zero at end of current 214. While pull-in current 206, intermediate current 208, and minimum current 210 are each illustrated as chopped currents formed by a series of repeating maxima and minima, if desired, each of currents 206, 208, and/or 210 may be fully or entirely formed by a current having more gradual changes in amplitude.

As understood, the amplitude of the current supplied to spill valve solenoid 40 and control valve solenoid 42 may correlate to the amount of force generated to pull and hold the spill valve member and control valve member 26, respectively, in their actuated positions. A higher pull-in current 206 may generate a greater amount of force, for example, to cause control valve member 26 to overcome static friction and other forces to move control valve member 26 to the injection position. Lower levels of current (e.g., intermediate current 208 and minimum hold-in current 210) may generate lower forces. In many instances, these forces may be sufficient to maintain control valve 24 in the injection position, as desired. However, due to persistent or transient conditions, such as conditions that cause resonance and spring surge, current 210 may be unable to retain member 26 in a fully-actuated position in some situations.

Following end of current 214, energy in solenoid 42 may generate a reduced amount of magnetic force that no longer holds control valve member 26 in the injection position. When valve member 26 returns from the actuated position (injection position) to the resting position (non-injection position), this movement may generate, via induction, a freewheeling current 216. This freewheeling current 216 may present a current peak 218 that corresponds to the timing at which valve member 26 returns to the resting position (e.g., by contacting a valve seat associated with the non-injection position). The time between end of current 214 and current peak 218, forms an end of injection delay time 220, the delay being the amount of time that elapses between the end of the current and the actual end of fuel injection. In some aspects, ECM 80 may be configured to monitor current waveforms 202 and 204. In particular, ECM 80 may be configured to detect current peak 218 and calculate delay time 220 based on the amount of time that elapses between end of current 214 and the peak 218 of freewheeling current 216. When delay time 220 for a series of injections is predictable (e.g., consistent), ECM 80 may be programmed to compensate for delay time 220, even when the delay is relatively large. While delay time 220 may be consistent under most circumstances, delay time 220 may tend to increase and decrease in an irregular manner when injector 12 experiences relatively high variability. For example, when delay time 220 decreases unexpectedly, ECM 80 may compensate (e.g., by causing end of current 214 to occur later in a subsequent injection). However, this compensation may result in later-than-intended end of injection if delay time 220 returns to an expected value. Thus, efforts of ECM 80 to compensate may contribute to variability before ECM 80 initiates a variability reduction mode.

When ECM 80 determines that fuel injector 12 is experiencing variability, and in particular, variability associated with control valve 24 due to spring surge or other causes, the amount of current applied in waveform 204 may be modified (i.e., increased or decreased), as part of the variability reduction mode. FIG. 2 illustrates an example of waveform 204 in which a portion of the hold-in current is increased for a period of time. This increase may occur during a portion or entirety of the time that minimum hold-in current is applied, resulting in an increased hold-in current 212 that is supplied instead of current 210. Increased hold-in current 212 may be larger in amplitude than a standard intermediate current 208, may be the same as intermediate current 208, or may remain less than intermediate current 208.

Increased hold-in current 212 may be larger than minimum current 210 by a predetermined fixed amount, or by an amount that is dynamically set with ECM 80. When current 210 is increased to current 212 by a predetermined amount, current 212 may be about 5%, 10%, 15%, 20%, or 25% larger than current 210. When the increase in current is dynamically set, ECM 80 may increase current 212 based on a value retrieved in a map or look-up table, as described below. As another alternative, ECM 80 may first increase current 212 by a first amount. When this first amount is found insufficient to decrease valve variability, current 212 may be increased by a larger second amount. Variability may be continuously or periodically evaluated, as described below, such that current 210 is boosted by increasing amounts when variability persists. A limit on the increased current (e.g., time limits and/or maximum amperages) may be applied for dynamically set current increases.

INDUSTRIAL APPLICABILITY

System 10 may be useful in any internal combustion engine, such as liquid fuel (e.g., diesel fuel, gasoline, etc.) engines, gaseous fuel engines, or dual-fuel engines (engines configured to combust both liquid fuel and gaseous fuel). System 10 may be utilized for generating power in a stationary machine (e.g., a generator or other electricity-generating device), in a mobile machine (e.g., an earthmoving device, a hauling truck, a drilling machine, etc.), or in other applications in which one or more fuel injectors 12 can experience variability.

During an injection event, the pressure of fuel within pressurized fuel passage 18 (FIG. 1) may increase when spill valve 20 is closed and a cam drives piston 14 downward. Control valve 24 may control whether fluid (e.g., fuel) within control chamber 36 is pressurized. When an injection is desired, ECM 80 may cause control valve 24 to move from the resting non-injection position in which high pressure fluid is present within control chamber 36 to the injection position in which control chamber 36 is connected to a low-pressure fuel drain. For example, ECM 80 may generate a command for supplying electrical energy to solenoid 42, while current is supplied to solenoid 40, for moving control valve 24 to the injection position. In the non-injection position, injection control valve 24 may block the injection of fuel, as pressurized fluid within control chamber 36 prevents fluid within nozzle chamber 32 from lifting injection member assembly 30 and opening one or more nozzle orifices. However, when control valve 24 is in the injection position, movement of injection member assembly 30 may be permitted by connecting control chamber 36 with a low-pressure fluid passage (e.g., a fluid drain).

Figures 3A, 3B, 3C:
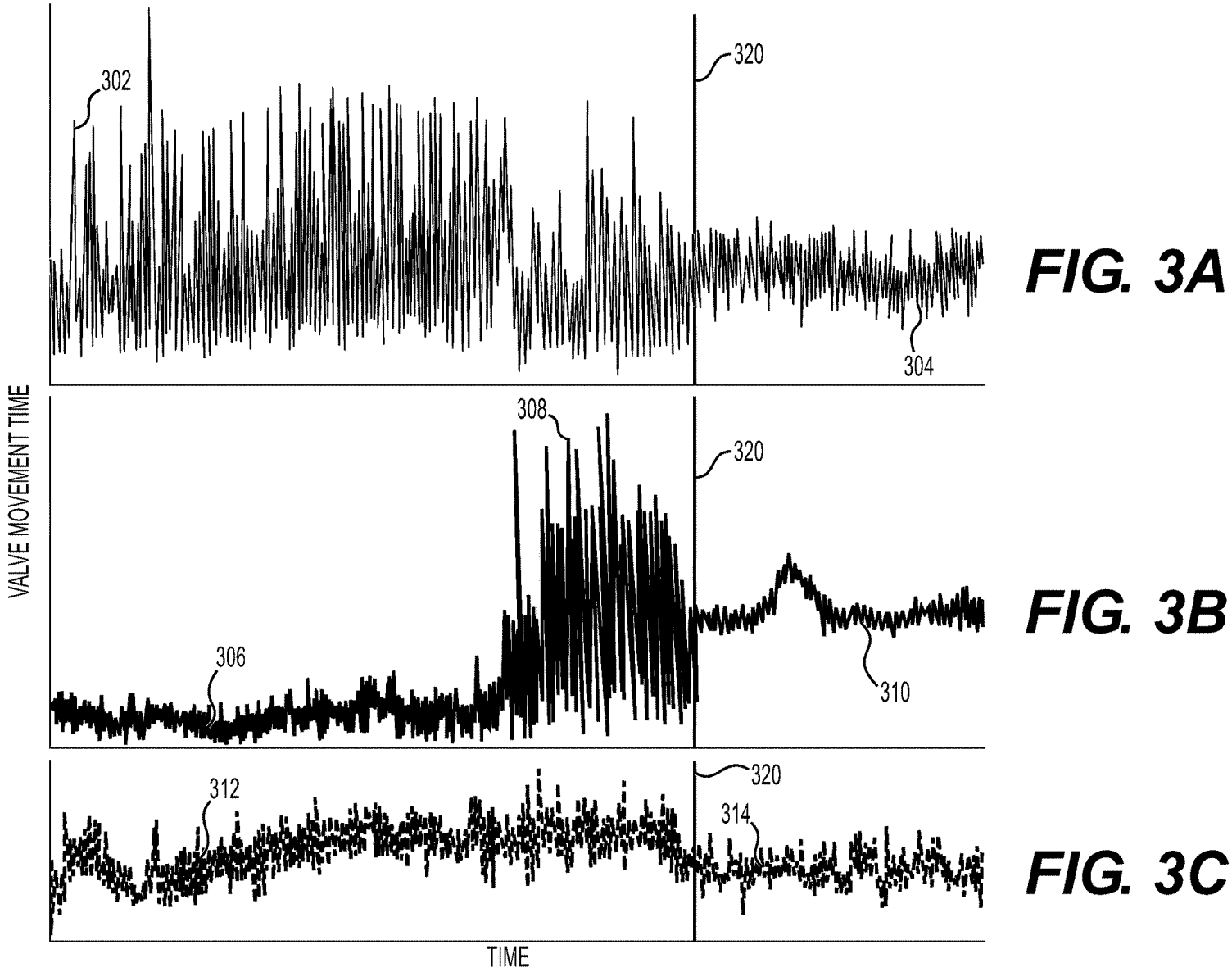
FIG. 3A is a chart showing a first example of fuel injection variability before and after entry into a variability reduction mode in the exemplary system shown in FIG. 1.
FIG. 3B is a chart showing a first example of fuel injection variability before and after entry into the variability reduction mode.
FIG. 3C is a chart showing a third example of fuel injection variability before and after entry into the variability reduction mode.
Figure 4:
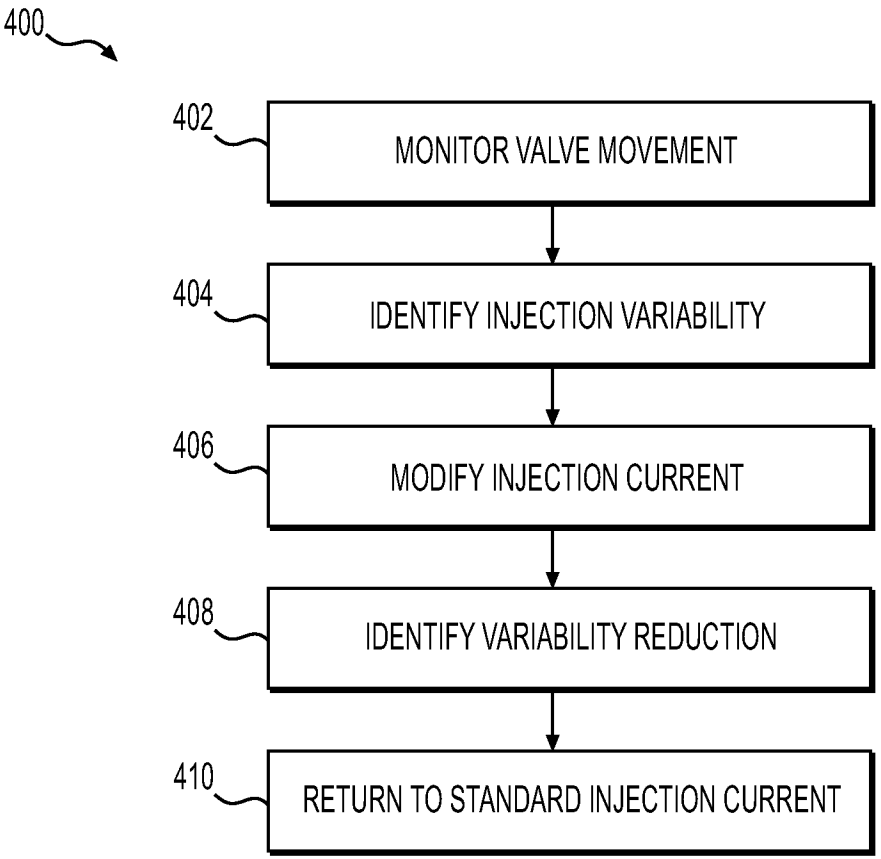
FIG. 4 is a flowchart depicting an exemplary fuel injection method, according to aspects of the disclosure.

FIGS. 3A, 3B, and 3C are charts illustrating exemplary valve movement times, and are described below in conjunction with FIG. 4. FIG. 4 is a flowchart illustrating an exemplary method 400 for reducing variability in a fuel injector, according to aspects of the present disclosure.

Method 400 may be performed during the operation of fuel injector system 10 to identify and reduce fuel injector movement variability. Method 400 may include a step 402 of monitoring valve movement. For example, ECM 80 may monitor freewheeling current generated as a result of movement of control valve member 26, and identify a return timing based on a peak of this current. In a particular example, the amount of time that elapses between the end of current and the valve return time, end of injection delay time 220 (FIG. 2), may be identified and monitored by ECM 80. FIGS. 3A, 3B, and 3C illustrate a series of these measurements for three exemplary fuel injectors, one injector being represented in each respective plot. Each plot in FIGS. 3A-3C represents valve movement timings for a plurality of fuel injections over a period of time. While plots for three fuel injectors are illustrated, as understood, all fuel injectors of a particular internal combustion engine may be monitored. Additionally, the steps described below, including steps that correct the performance of the fuel injector, may be performed for an individual injector without altering the performance of the remaining fuel injectors.

A step 404 may include identifying injection variability. This variability may be identified with ECM 80 based on the valve movements monitored in step 402. For example, ECM 80 may evaluate values of delay time 220 to determine when a valve of a particular injector 12, such as control valve 24, is experiencing variability. In particular, ECM 80 may calculate a value that represents the deviation of an individual valve movement time. This deviation may be, for example, calculated by comparing a delay time 220 to an average value or mean value for a series of previous delay times 220. In an alternate example, the deviation may be calculated by comparing end of injection delay time 220 to a predetermined expected or desired delay time, instead of comparing delay time 220 to a plurality of previously-identified delay times 220. The deviation value may be, for example, a standard deviation calculated by ECM 80.

Injection variability may be identified based on one deviation value or a plurality of deviation values calculated over time. In one example, injection variability may be identified when deviation values calculated for a certain number of injections (e.g., 5, 10, 15, 20 injections or more), each exceed a predetermined deviation threshold, or when the average of these deviation values exceeds a predetermined threshold. If desired, variability may be determined when a certain number of injections, such as 5, 10, 15, 20, etc., within a certain period of time exhibit variability. If desired, the number of injections and/or the period of time may be set by an operator of the machine or internal combustion engine.

The deviation threshold for identifying an injector experiencing variability may be either a single static value or a dynamic value that can change over time. When the deviation threshold is a dynamically-set standard deviation or other value that represents and allowable deviation, ECM 80 may set this value based on one or more conditions measured with sensor 90 or calculated condition(s) of the internal combustion engine and/or injector 12. The value may be stored in a map or look-up table that allows the predetermined deviation threshold to change based on an injection amount (e.g., a desired quantity of fuel to be injected by injector 12). The map or look-up table may, for example, cause the value of the predetermined deviation threshold to increase when the quantity of injected fuel decreases. Thus, the value of the threshold may decrease with increasing injection quantities. The predetermined deviation may change based on other conditions measured with sensor 90, such as engine speed, engine load, engine temperature, and/or other conditions.

FIGS. 3A-3C are charts illustrating a series of exemplary valve movement (e.g., return) times for three fuel injectors. A first injector represented in FIG. 3A experiences persistent variability. A second fuel injector represented in FIG. 3B experiences intermittent variability. For purposes of comparison, FIG. 3C illustrates valve movement times for a fuel injector that is stable and not experiencing variability. In FIGS. 3A-3C, increasing variability is represented by larger changes in amplitude over a particular period of time.

The first fuel injector, with persistent variability, exhibits a high-variability region 302 in FIG. 3A that continues until timing 320, which is described below. ECM 80 may identify injection variability based on high-variability region 302, according to the above-described performance of step 404. The second fuel injector with intermittent variability exhibits a high-variability region 308 in FIG. 3B that follows stable region 306. ECM 80 may also identify variability in injectors that experience intermittent or sudden variability, as represented by region 308.

The onset of variability, as represented by region 308, may be caused by changing engine parameters, physical disturbances, or other conditions that vary over time. These conditions may introduce resonance in injector 12, and in particular, may cause resonance in spring 22, which biases control valve 24. This resonance may be intermittent or persistent. Additionally, persistent variability may be associated with other causes or additional causes.

A step 406 of modifying injection current may be performed in response to the identification of injector variability and in particular, variability associated with control valve 24. In some aspects, the modification may tend to increase the injection current during some or all of a hold-in portion of a current waveform. For example, ECM 80 may cause an increase in current from standard (minimum) current level 210 to increased current level 212 (FIG. 2). While FIG. 2 illustrates this modification occurring at an entirety of the minimum hold-in current level, if desired, the increased current may be supplied for only a portion of this period of time. In another alternative, the increased current level may be applied during intermediate hold-in current 208, in addition to the current supplied immediately after hold-in current 208 is supplied.

In FIGS. 3A-3C, ECM 80 enters the above-describe variability reduction mode at timing 320. Thus, valve movement timings before timing 320 (to the left of timing 320 in FIGS. 3A-3C) represent variability that may occur when minimum current level 210 is supplied. Valve movement timings after timing 320 (to the right of timing 320) represent valve movement and variability for a series of injection in which current 210 is changed (e.g., increased to hold-in current 212 or to another value different than the standard current 210). As understood, timing 320 in FIGS. 3A-3C is not necessarily representative of the timing at which ECM 80 enters the variability reduction mode. For example, ECM 80 may begin supplying increased current at a timing earlier than boost timing 320 for the fuel injector associated with high-variability region 302, high-variability region 308, or both, by entering the variability reduction mode as soon as variability is determined.

As illustrated in FIGS. 3A and 3B, the increase in current may be sufficient to reduce the variability of a fuel injector experiencing consistent variability and to reduce variability of a fuel injector experiencing intermittent variability. This is illustrated by the transition of high-variability region 302 to stabilized region 304, and the change from high-variability region 308 to stabilized region 310.

As indicated above, FIG. 3C includes a representation of a third, stable fuel injector, for comparison purposes. This stable fuel injector may have injector movements, as illustrated in stable region 312, that are consistent in comparison to high-variability region 302 and high-variability region 308. As represented in FIG. 3C, the application of a variability reduction mode at timing 320 to this consistent injector results in another stable region 314. Thus, the application of the variability reduction mode to an injector experiencing little or no variability does not negatively impact operation of the injector.

In a step 408, after applying an increased amount of hold-in current for a period of time, ECM 80 may evaluate whether the variability has been corrected. This may be determined by evaluating the current amount of injector variability. If this variability is below a certain level for a predetermined period of time, ECM 80 may determine that the variability was resolved. In response to this determination, the variability reduction mode may be discontinued, and the amount of hold-in current may return to a standard level. This may result in reduced energy consumption and avoid increased heat which may be associated with increased current within solenoid 42.

Additionally or alternatively, ECM 80 may return to standard injection current by terminating the variability reduction mode in response to one or more engine conditions, such as conditions measured with sensor 90. For example, ECM 80 may return to standard injection current during a transient condition, such as a change in engine speed or a change in engine load. Similarly, ECM 80 may delay or deny entry into the variability reduction mode, in step 406, based on a system voltage and/or a temperature condition. For example, ECM 80 may deny entry when system voltage is unsuitable for increasing current or when temperature is low (e.g., during cold conditions or at startup).

While steps 402, 404, 406, and 408 were described in an exemplary order, as understood, one or more of these steps may be performed in a different order, or in a partially or fully overlapping manner.

Figure 5:
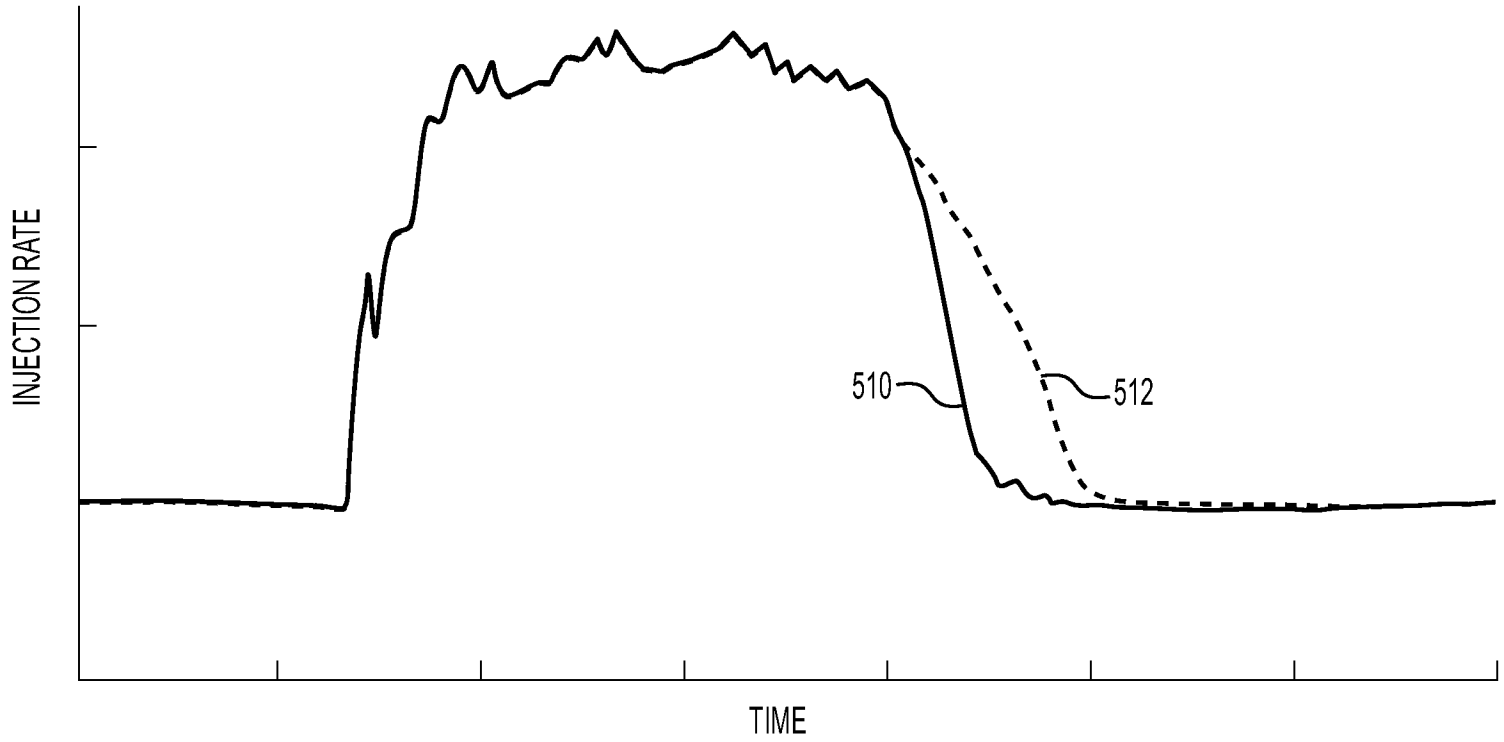
FIG. 5 is a chart showing exemplary fuel injection rates, with and without current adjustment, which may represent fuel injected with the exemplary system shown in FIG. 1.

FIG. 5 illustrates an exemplary effect of the variability reduction mode when applied to a fuel injector experiencing variability in valve movement timing. In FIG. 5 the vertical axis represents injection rate and the horizontal axis represents time. Thus, the area under each curve represents a total amount of fuel injected during an injection event. An uncorrected injection rate 510 corresponds to the rate of injected fuel for a fuel injector currently experiencing variability. Corrected injection rate 512 represents the amount of fuel injected once ECM 80 increases the hold-in current for control valve 28 during the variability reduction mode.

As shown in FIG. 5 the uncorrected injection rate 510 may be smaller than the desired amount of injection, which corresponds to corrected injection rate 512. This may be caused, for example, by disruptions (e.g., resonance) in spring member 22 which allow control valve 24 to begin returning from the actuated (injection) position to a resting or non-injection position at a timing that is earlier than desired. The desired amount of injection represented by injection rate 512 may be achieved by increasing the amount of hold-in current during a portion of the hold-in tier, as described above. However, system 10 and method 400 may be suitable for addressing other types of injector variability. While FIG. 5 illustrates an example where the injection amount is smaller than desired, system 10 and method 400 may be equally applicable to injection variability that results in the injection of a larger than desired amount of fuel.

While system 10 is described above as including a mechanically-actuated electronically-controlled unit injector, fuel injector 12 may instead be a common rail fuel injector, a gaseous fuel injector, or another type of fuel injector, including injectors that include only a single solenoid-controlled valve. Fuel injector 12 may include a plurality of spring-biased valves, with spill valve 20 control valve 24 being an example of such valves, these valves being biased by the same spring member. However, system 10 may be applied to systems having multiple spring that bias respective valves, if desired.

The disclosed system and method may be useful for identifying and reducing injector variability, including variability associated with deviations in valve return time and, in particular, variability in the amount of time that elapses from the end of current to the end of injection. Reducing injector variability may enable accurate control over fuel injector quantity, generating a desired amount of power with an internal combustion engine. Reduced injector variability may enable increased control over engine emissions, preventing the generation and release of undesired compounds. Additionally, control of a variability reduction mode with an ECM may avoid unnecessary application of a variability reduction mode, reducing the amount of energy consumed and targeting the mode only to injectors which would benefit from a change in the amount of supplied current.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A fuel injection system, comprising:
- a fuel injector, the fuel injector having:
  - an injection control valve; and
  - a solenoid that, when energized, is configured to modify a position of the injection control valve; and
- a controller configured to:
  - generate a command for energizing the solenoid,
  - identify a transient variability in injection events due to increased end of injection timings and decreased end of injection timings over a plurality of injections, and
  - based on the identified transient variability, increase an amount of energy supplied to the solenoid.

2. The fuel injection system of claim 1, wherein the fuel injector also includes a spill valve.

3. The fuel injection system of claim 1, wherein the controller is configured to increase the amount of energy supplied to the solenoid during a hold-in portion of a fuel injection.

4. The fuel injection system of claim 3, wherein the increased amount of current supplied to the solenoid during the hold-in portion of the fuel injection is less than an amount of current applied to the solenoid during a pull-in portion of the fuel injection before entering a variability reduction mode, the increased amount of current supplied to the solenoid during the hold-in portion of the fuel injection being greater than the amount of current applied to the solenoid during the pull-in portion of the fuel injection.

5. The fuel injection system of claim 1, wherein the controller is configured to increase the amount of energy supplied to the solenoid for a plurality of injection events.

6. The fuel injection system of claim 5, wherein the controller is configured to return the amount of energy supplied to the solenoid from the increased amount to a standard amount after the plurality of injection events.

7. The fuel injection system of claim 1, wherein the increased amount of energy corresponds to an increase in an amount of current through the solenoid, the increase being at least about 5% larger than a standard amount of current through the solenoid.

8. A method for reducing injection variability in a fuel injector having an injection control valve, the method comprising:
- monitoring a fuel injector to determine a timing of movement of the injection control valve;
- identifying a change in a variability of the timing of valve movement for the monitored fuel injector over a plurality of fuel injections, indicating an intermittent variability, based on current induced by movement of the injection control valve; and changing a quantity of current supplied to actuate the injection control valve based on the change in the timing of valve movement.

9. The method of claim 8, further including identifying a change in an operating condition of an internal combustion engine and returning the quantity of current to a standard amount of current based on the change in the operating condition.

10. The method of claim 9, wherein the change in the operating condition is one or more of: a change in engine speed, a change in load, or a change in temperature.

11. The method of claim 8, wherein the current induced by motion of the injection control valve is a freewheeling current generated with the injection control valve.

12. The method of claim 8, wherein the change in the timing of movement is a change in the variability of the injection control valve when moving from an injection position to a non-injection position.

13. The method of claim 12, further including determining that the variability of the injection control valve exceeds a predetermined variability.

14. The method of claim 8, wherein the fuel injector is included as one fuel injector of a plurality of fuel injectors installed in an internal combustion engine, wherein identifying the change in the timing of valve movement is performed for the one fuel injector of the plurality of fuel injectors, wherein the change in quantity of current causes the one fuel injector have a higher quantity of current as compared to the other fuel injectors of the plurality of fuel injectors.

15. A controller for use in a fuel injection system that includes an internal combustion engine and at least one fuel injector, the controller being programmed to:

generate a command for energizing a control valve solenoid;

determine that a fuel injector movement variability exceeds a movement variability threshold associated with repeated deviations in return timing of a control valve that occur intermittently during operation of the at least one fuel injector; and based on determining that the fuel injector movement variability exceeds the movement variability threshold, entering a variability reduction mode in which an amount of energy energizing the control valve solenoid is increased for at least a portion of a fuel injection event.

16. The controller of claim 15, wherein the controller is further programmed to set the movement variability threshold based on a quantity of fuel injected with the at least one fuel injector.

17. The controller of claim 15, wherein the controller is further programmed to set the movement variability based on a plurality of prior fuel injector movement measurements.

18. The controller of claim 15, wherein the movement variability threshold is a fixed value.

19. The controller of claim 15, wherein the controller is further programmed to generate a command for increasing an amount of current supplied to energize the control valve solenoid by at least about 5% during the variability reduction mode.

20. The controller of claim 19, wherein the command is for suppling current during a hold-in tier of an injection event.

* * * * *